US005342228A

United States Patent [19]

Magee et al.

[11] Patent Number: 5,342,228

[45] Date of Patent: Aug. 30, 1994

[54] MARINE DRIVE ANODE

[75] Inventors: Phillip D. Magee; Edward C. Eick; Gary L. Meisenburg, all of Stillwater, Okla.

[73] Assignee: Brunswick Corporation, Lake Forest, Ill.

[21] Appl. No.: 83,980

[22] Filed: Jun. 28, 1993

Related U.S. Application Data

[63] Continuation-in-part of Ser. No. 889,495, May 27, 1992, Pat. No. 5,230,644, and a continuation-in-part of Ser. No. 889,530, May 27, 1992, Pat. No. 5,249,995.

[51] Int. Cl.[5] ..... B63H 21/24

[52] U.S. Cl. ..... 440/76; 440/80

[58] Field of Search ..... 440/75–83, 440/900, 113; 204/196, 197, 147, 148; 123/195 P

[56] References Cited

U.S. PATENT DOCUMENTS

| | | | |
|---|---|---|---|
| 3,240,180 | 3/1966 | Byrd | 204/196 |
| 3,589,204 | 6/1971 | Langley | 440/78 |
| 3,952,686 | 4/1976 | Pichl | 115/17 |
| 4,630,719 | 12/1986 | McCormick | 192/21 |
| 4,679,682 | 7/1987 | Gray, Jr. et al. | 192/21 |
| 4,764,135 | 8/1988 | McCormick | 440/83 |
| 4,790,782 | 12/1988 | McCormick | 440/61 |
| 4,792,315 | 12/1988 | Karrasch et al. | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,863,406 | 9/1989 | Bland et al. | 440/83 |
| 4,869,121 | 9/1989 | Meisenburg | 440/80 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,993,848 | 2/1991 | John et al. | 440/78 |

FOREIGN PATENT DOCUMENTS

| | | | |
|---|---|---|---|
| 0067696 | 4/1986 | Japan | 440/78 |
| 0097493 | 4/1988 | Japan | 440/76 |

*Primary Examiner*—Edwin L. Swinehart

*Attorney, Agent, or Firm*—Andrus, Sceales, Starke & Sawall

[57] ABSTRACT

A marine drive is provided with a large volume anode, about 30 cubic inches, for galvanic protection. The anode (230) is a brick-like block member tapered along each of its height, width and length dimensions. The drive housing has an anode-mounting section (232) extending rearwardly therefrom and has a downwardly opening cavity (234) of substantially the same shape and volume as the anode, and receiving the anode in nested flush relation.

19 Claims, 5 Drawing Sheets

MARINE DRIVE ANODE

CROSS REFERENCE TO RELATED APPLICATIONS

This application is a continuation-in-part of allowed U.S. application Ser. No. 07/889,495 filed May 27, 1992, now U.S. Pat. No. 5,230,644 and allowed U.S. application Ser. No. 07/889,530, filed May 27, 1992, now U.S. Pat. No. 5,249,995 incorporated herein by reference.

BACKGROUND AND SUMMARY

The invention relates to a marine drive, and more particularly to a sacrificial anode.

The invention arose during development efforts directed toward a surfacing marine drive enabling increased top end boat speed, though the invention is not limited thereto. Surfacing drives are known in the art, for example U.S. Pat. No. 4,871,334, column 3, lines 35+.

Sacrificial anodes for galvanic protection of marine drives are also known in the art.

The present invention provides an improved anode and anode-mounting structure.

DETAILED DESCRIPTION

Figure 1:
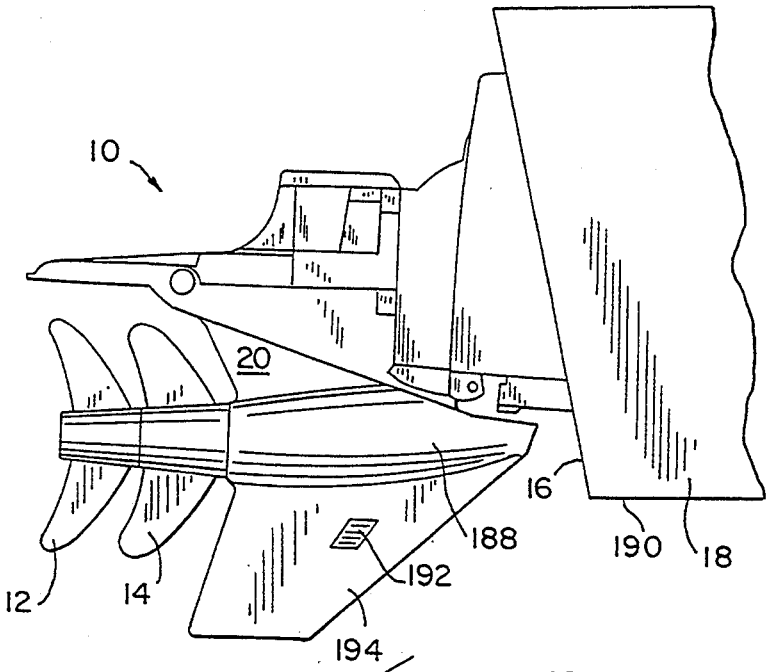
FIG. 1 is a side elevation view of a marine drive in the noted parent applications.

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to an input shaft 32 driven by the engine (not shown) in the boat. The universal joint enables trimming and steering of the drive. The input shaft drives an upper gear assembly 34 which is known in the art, for example as shown in U.S. Pat. Nos. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
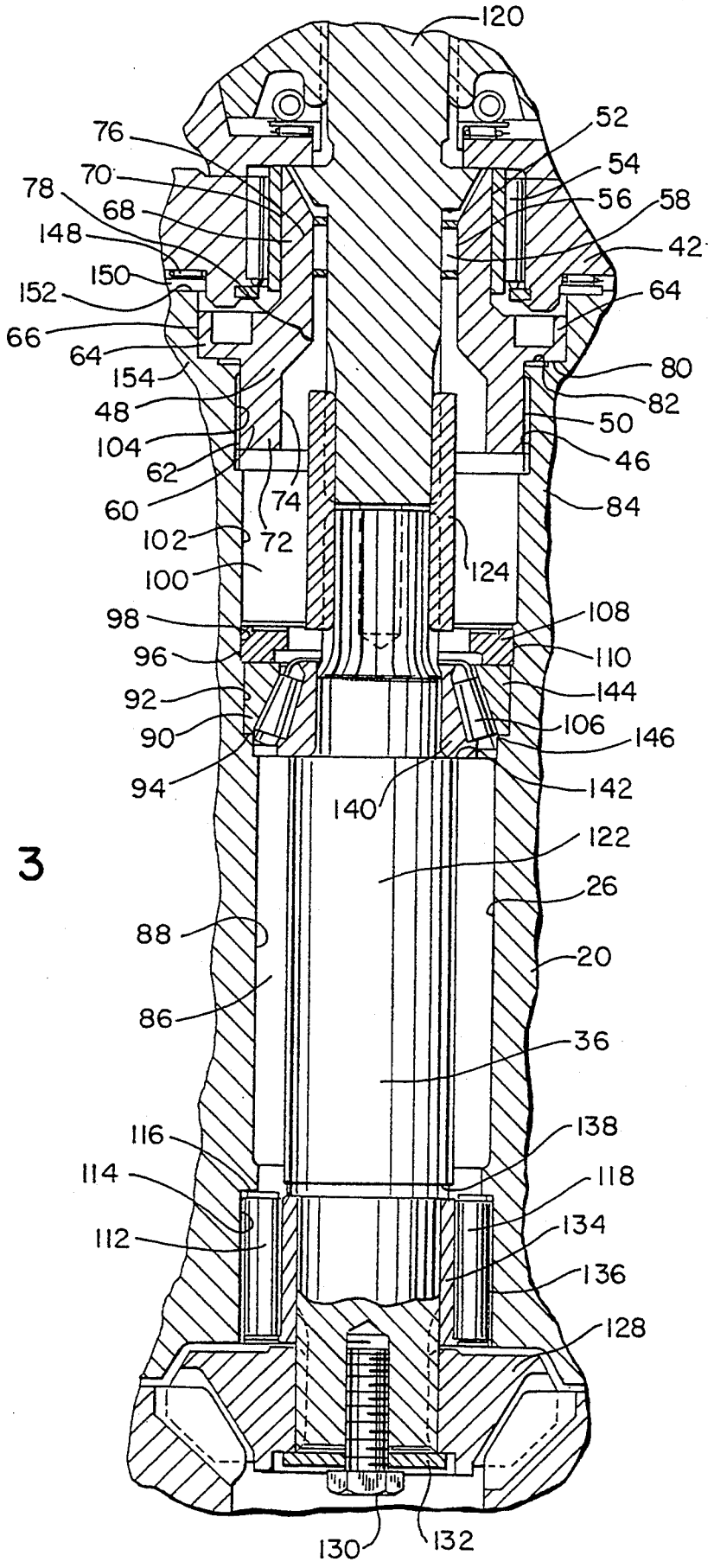
FIG. 3 is an enlarged view of a portion of the structure of FIG. 2.
Figure 5:
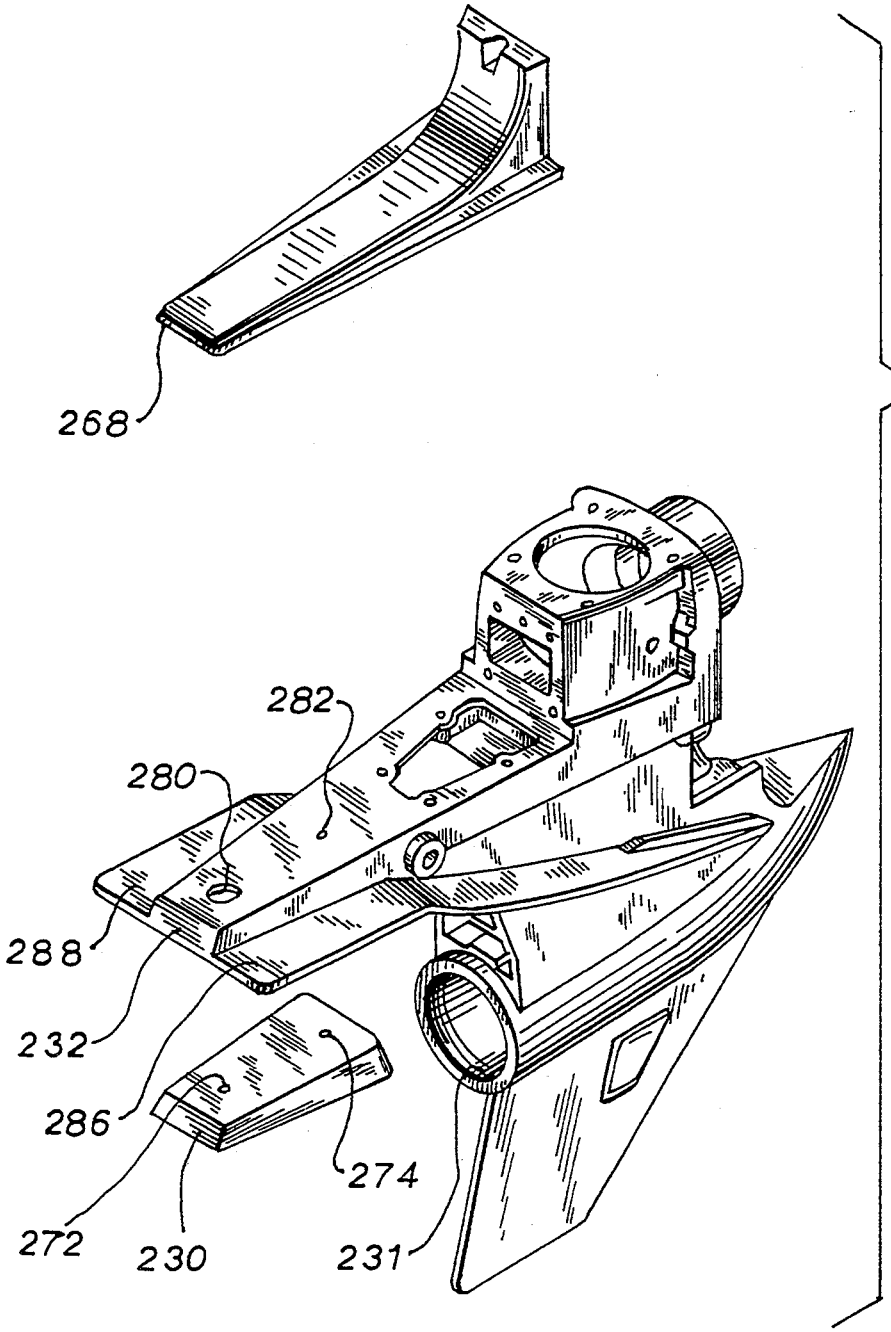
FIG. 5 is an exploded isometric view of a portion of the structure of FIG. 1 modified in accordance with the invention.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports driveshaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Figure 4:
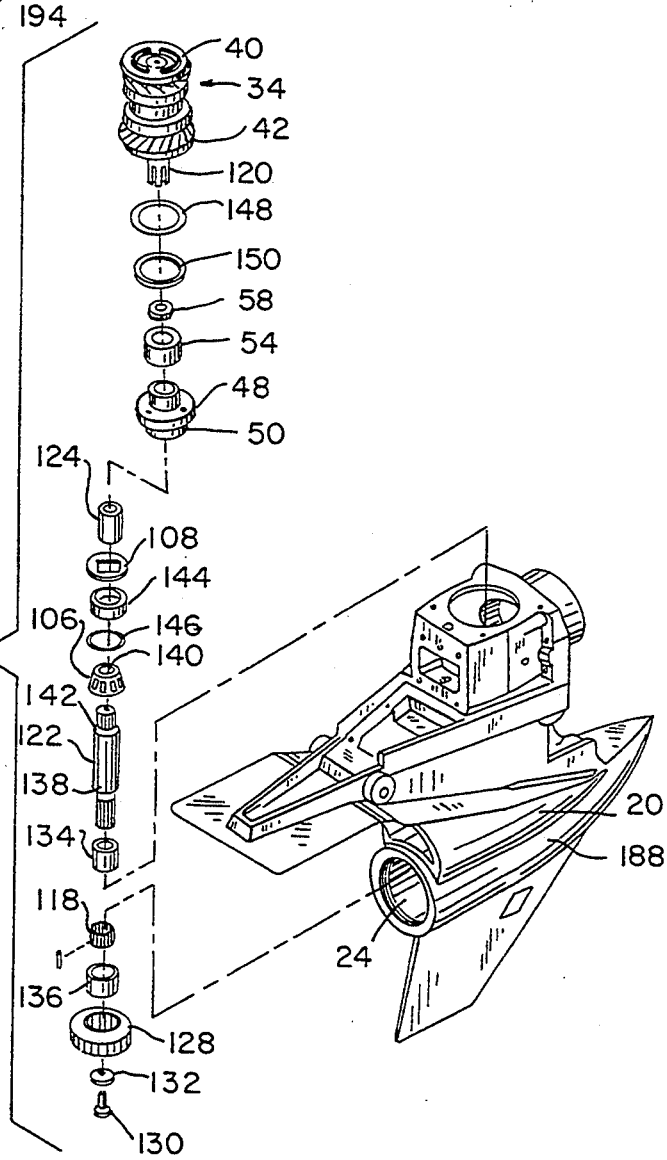
FIG. 4 is an exploded isometric view of a portion of the structure of FIG. 1.

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98. Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 is seated against downwardly facing shoulder 116 and supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing 118 is above pinion gear 128 and is supported between inner and outer races 134 and 136. Outer race 136 engages shoulder 116, and inner race 134 engages shoulder 138 on lower driveshaft segment 122. Bearing 106 has an inner race 140 engaging shoulder 142 on lower driveshaft segment 122. Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
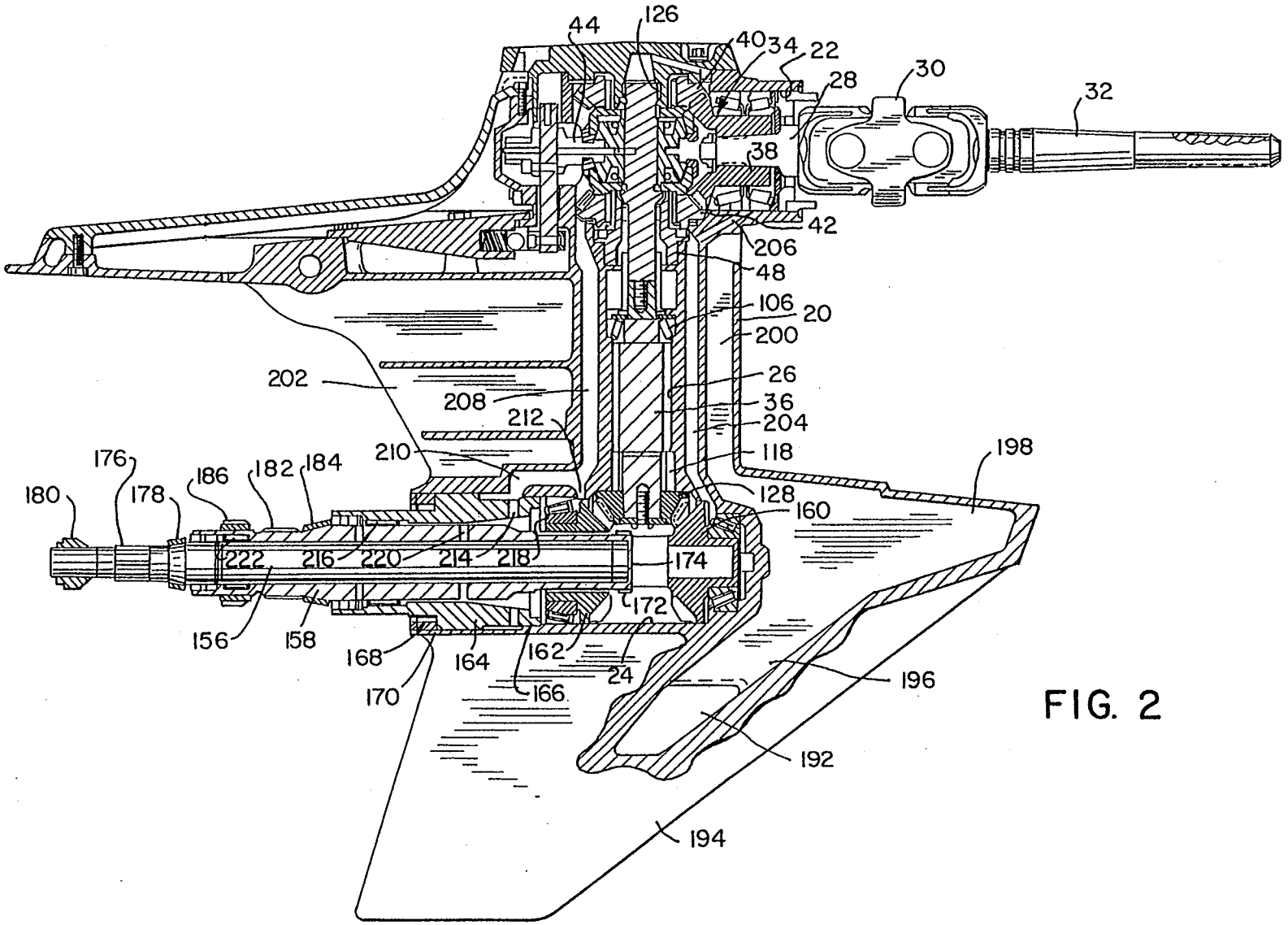
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 56. Outer propeller shaft 158 has an aft gear 162 driven by pinion gear 128 to drivingly rotate outer propeller shaft 158 in the opposite rotational direction than inner propeller shaft 156. Reference is made to allowed incorporated U.S. application Ser. No. 07/889,530, filed May 27, 1992. The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without a like raising of the engine in the boat nor the usual transom mounting location for the drive. In the preferred embodiment, the engine is raised 2 to 3 inches above its standard location. Housing 20 is a one-piece unitary integrally cast housing replacing prior two piece housings. Propeller shafts 156, 158 are spaced from upper input shaft 28 by a distance along driveshaft 36 in the range of about 8 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. No. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

FIGS. 5–8 show a modification in accordance with the invention. Sacrificial anode 230 is mounted to drive housing 231 above propellers 12 and 14 and has a volume of approximately 30 cubic inches, which is significantly greater than standard anodes. The increased volume provides enhanced galvanic protection. The drive housing has rearwardly extending anode-mounting section 232 above the propellers. Anode-mounting section 232 has a cavity 234, FIG. 6, opening downwardly toward the propellers. Anode 230 and cavity 234 have substantially the same volume, and anode 230 substantially fills cavity 234.

In the preferred embodiment, anode 230 is a generally brick-like block member having a height of about 1 inch, a fore-to-aft length of about 8 inches, and a right-to-left width of about 4 inches. Cavity 234 likewise has a height of about 1 inch, a fore-to-aft length of about 8 inches, and a right-to-left width of about 4 inches. The anode material is anodic aluminum alloy sold under the tradename Martyr II by Custom Metal Alloyers Ltd., 638 Derwent Way, Annacis Industrial Park, New Westminster, British Columbia, B3M 5P8. The anode weighs approximately 3 lbs.

Anode 230 is tapered along each of its dimensions. The anode has a height tapering fore-to-aft such that the height 236, FIG. 7, at the front of the anode is greater than the height 238 at the rear of the anode. Height 236 is approximately 1.2 inch, and height 238 is approximately 1 inch. The anode has a right-to-left width tapering fore-to-aft such that the width 240 at the front of the anode is greater than the width 242 at the rear of the anode. Width 240 is approximately 3.8 inches, and width 242 is approximately 2.4 inches. The widths at the bottom of the block are larger; for example, width 244 is approximately 3.1 inches, and the width at the front bottom of the block is approximately 3.9 inches. The anode has a fore-to-aft length tapering upwardly such that the length 248 at the bottom of the anode is greater than the length 250 at the top of the anode. Length 248 is approximately 8.2 inches, and length 250 is approximately 7.7 inches.

Figure 8:
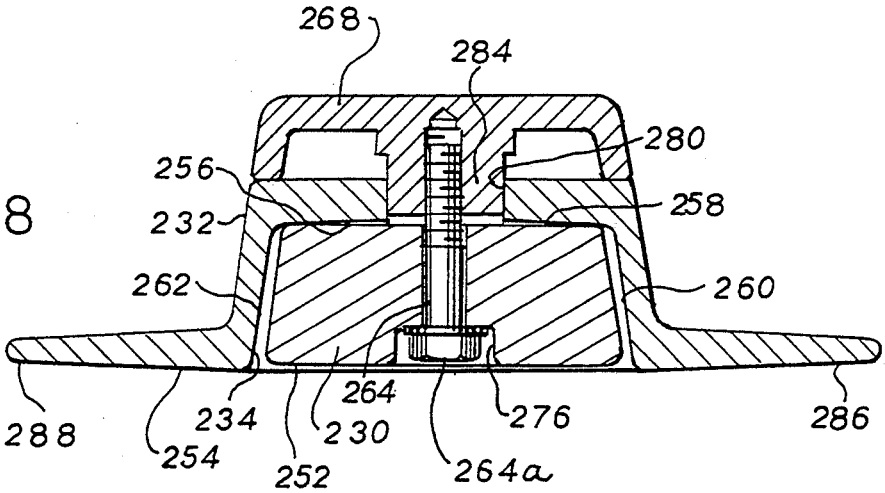
FIG. 8 is a sectional view taken along line 8—8 of FIG. 6.

Anode 230 is received in cavity 234 in substantially flush relation such that the underside 252, FIG. 8, of anode 230 is substantially flush with the underside 254 of anode-mounting section 232. Anode 230 and cavity 234 have substantially the same shape and dimensions. All of anode 230 is entirely above underside 254 of anode-mounting section 232. Cavity 234 has a top horizontal wall 256 engaged by the topside 258 of anode 230 in abutting relation. Top wall 256 has a right-to-left width tapering fore-to-aft such that the width at the front is greater than the width at the rear. Anode 230 is tapered, as above described, to match the taper of top wall 256. Cavity 234 has vertical sidewalls 260 and 262 having a height tapering fore-to-aft such that the height at the front is greater than the height at the rear. Anode 230 is tapered, as above described, to match the taper of sidewalls 260 and 262.

Figure 6:
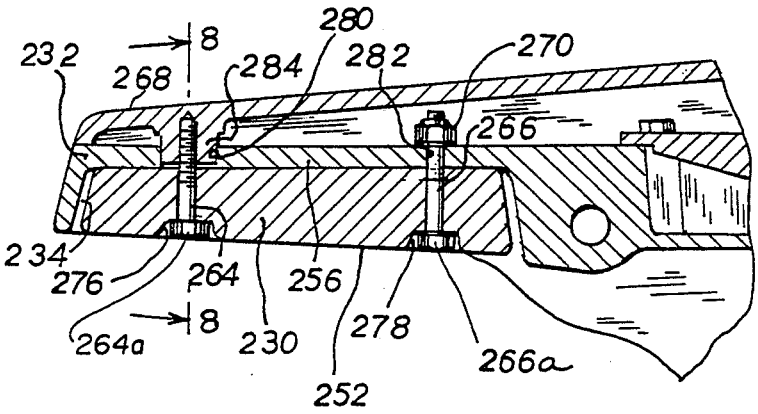
FIG. 6 is an enlarged sectional view of a portion of the structure of FIG. 5.
Figure 7:
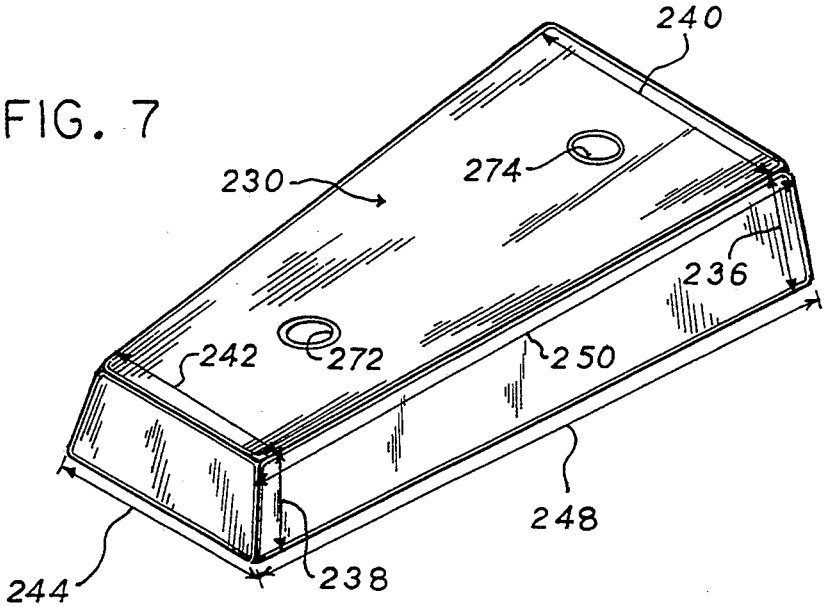
FIG. 7 is an isometric view of an anode in accordance with the invention.

Anode 230 is mounted to anode-mounting section 232 of the drive housing by a pair of bolts 264 and 266, FIGS. 6 and 8. Bolt 264 extends upwardly through anode 230 and anode-mounting section 232 and is secured to a cover 268 over anode-mounting section 232 and covering the rearwardly extending portion of the drive housing. Bolt 266 extends upwardly through anode 230 and is secured to anode-mounting section 232 at lock nut 270. Anode 230 has a pair of vertical bores 272 and 274 therethrough, FIG. 7, receiving bolts 264 and 266, respectively. Each bore has an increased diameter at its lower end, as shown at 276 and 278, FIG. 6, for receiving its respective bolt head 264*a* and 266*a* in flush relation with the underside 252 of the anode. Top wall 256 of cavity 234 has a pair of apertures 280 and 282 therethrough. Aperture 280 receives bolt 264 extending upwardly therethrough. Aperture 282 receives bolt 266 extending upwardly therethrough. Aperture 280 has a larger diameter than aperture 282. Cover 268 has a boss 284, FIG. 6, extending downwardly into aperture 280 and receiving bolt 264 in threaded relation.

It is preferred that the underside 252 of anode 230 be flush with underside 254 of anode-mounting section 232 particularly in surfacing drive applications because the rightward and leftward extensions 286 and 288, FIG. 8, of undersurface 254 provide a planing plate during initial boat acceleration to aid the boat getting up on plane, and then act as a splash plate, as noted in commonly owned co-pending U.S. application Ser. No. 08/084,346, filed on even date herewith. The smooth undersurface provided by underside 252 flush with underside 254 aids the planing and minimizes turbulence.

It is recognized that various equivalents, alternatives and modifications are possible within the scope of the appended claims.

We claim:

1. A marine drive for propelling a boat comprising a housing having a lower torpedo portion with at least one propeller shaft driving at least one propeller, an anode mounted to said housing above said propeller, said anode having a volume greater than 20 cubic inches, said housing have an anode-mounting section extending rearwardly therefrom above said propeller, said anode-mounting section having a cavity opening downwardly toward said propeller and receiving said anode therein.

2. The invention according to claim 1 wherein anode volume is ≧30 cubic inches.

3. The invention according to claim 2 wherein said anode and said cavity have substantially the same volume, and wherein said anode substantially fills said cavity.

4. The invention according to claim 1 wherein said anode is a block member having a height of about 1 inch, a fore-to-aft length of about 8 inches, and a width of about 4 inches.

5. The invention according to claim 4 wherein said cavity has a height of about 1 inch, a fore-to-aft length of about 8 inches, and a width of about 4 inches.

6. A marine drive for propelling a boat comprising a housing having a lower torpedo portion with at least one propeller shaft driving at least one propeller, an anode mounted to said housing above said propeller, said anode being a tapered block member having at least one tapered dimension, said housing having an anode-mounting section extending rearwardly therefrom above said propeller, said anode-mounting section having a cavity opening downwardly toward said propeller and receiving said anode therein.

7. The invention according to claim 6 wherein said anode has a height tapering fore-to-aft such that the height at the front of the anode is greater than the height at the rear of the anode.

8. The invention according to claim 6 wherein said anode has a right-to-left width tapering fore-to-aft such that the width at the front of the anode is greater than the width at the rear of the anode.

9. The invention according to claim 6 wherein said anode has at least two tapered dimensions, said anode having a height tapering fore-to-aft such that the height at the front of the anode is greater than the height at the rear of the anode, said anode having a right-to-left width tapering fore-to-aft such that the width at the front of the anode is greater than the width at the rear of the anode.

10. The invention according to claim 6 wherein said anode has a fore-to-aft length tapering upwardly such that the length at the bottom of the anode is greater than the length at the top of the anode.

11. The invention according to claim 6 wherein each of the height, width and length of the anode is tapered, said anode having a height tapering fore-to-aft such that the height at the front of the anode is greater than the height at the rear of the anode, said anode having a right-to-left width tapering fore-to-aft such that the width at the front of the anode is greater than the width at the rear of the anode, said anode having a fore-to-aft length tapering upwardly such that the length at the bottom of the anode is greater than the length at the top of the anode.

12. A marine drive for propelling a boat comprising a housing having a lower torpedo portion with at least one propeller shaft driving at least one propeller, an anode mounted to said housing above said propeller, said housing having an anode-mounting section extending rearwardly therefrom above said propeller, said anode-mounting section having a cavity opening downwardly toward said propeller, said anode being received in said cavity in substantially flush relation such that the underside of said anode is substantially flush with the underside of said anode-mounting section.

13. The invention according to claim 12 wherein said anode and said cavity have substantially the same shape and substantially the same dimensions.

14. The invention according to claim 12 wherein said cavity has a top horizontal wall engaged by the topside of said anode in abutting relation.

15. The invention according to claim 14 wherein said top wall has a right-to-left width tapering fore-to-aft such that the width at the front is greater than the width at the rear, and wherein said anode is tapered to match the taper of said top wall.

16. The invention according to claim 12 wherein said cavity has vertical sidewalls having a height tapering fore-to-aft such that the height at the front is greater than the height at the rear, and wherein said anode is tapered to match the taper of said sidewalls.

17. A marine drive for propelling a boat comprising a housing having a lower torpedo portion with at least one propeller shaft driving at least one propeller, an anode mounted to said housing above said propeller, said housing having an anode-mounting section extending rearwardly therefrom above said propeller, and a cover over said anode-mounting section, said anode being mounted to said housing by a pair of bolts, including a first bolt extending upwardly through said anode and said anode-mounting section and secured to said cover, and a second bolt extending upwardly through said anode and secured to said anode-mounting section.

18. The invention according to claim 17 wherein said anode-mounting section has a cavity opening downwardly toward said propeller, said anode being received in said cavity in substantially flush relation such that the underside of said anode is substantially flush with the underside of said anode-mounting section, and wherein said anode has a pair of vertical bores therethrough receiving said bolts, each bore having an increased diameter at its lower end for receiving a bolt head in flush relation with the underside of said anode.

19. The invention according to claim 17 wherein said anode-mounting section has a cavity opening downwardly toward said propeller, said cavity having a top wall with a pair of apertures therethrough, including a first aperture receiving said first bolt extending upwardly therethrough, and a second aperture receiving said second bolt extending upwardly therethrough, said first aperture having a larger diameter than said second aperture, said cover having a boss extending downwardly into said first aperture and receiving said first bolt in threaded relation.

* * * * *